US006230771B1

(12) United States Patent
Hellenbrand

(10) Patent No.: US 6,230,771 B1
(45) Date of Patent: May 15, 2001

(54) MODULAR CARRY-ALL ASSEMBLY

(76) Inventor: Sherri Renee Hellenbrand, 1620 Johnson St., Stoughton, WI (US) 53589

( * ) Notice: Subject to any disclaimer, the term of this patent is extended or adjusted under 35 U.S.C. 154(b) by 0 days.

(21) Appl. No.: 09/520,467

(22) Filed: Mar. 7, 2000

(51) Int. Cl.[7] ..... A45C 2/00; A45C 13/30

(52) U.S. Cl. ..... 150/111; 150/113; 190/102; 190/108; 190/111

(58) Field of Search ..... 150/106, 111, 150/113; 190/102, 108

(56) References Cited

U.S. PATENT DOCUMENTS

| | | | | |
|---|---|---|---|---|
| 587,251 | | 7/1897 | Wilentshik . | |
| 673,173 | * | 4/1901 | Le Fevre | 190/102 |
| 1,425,217 | | 8/1922 | Regulski . | |
| 2,672,903 | | 3/1954 | Machinist | 150/28 |
| 2,721,596 | * | 10/1955 | Danneil | 150/106 |
| 2,813,602 | | 11/1957 | MacArthur, Jr. | 190/60 |
| 3,001,566 | | 9/1961 | Lipsitz | 150/12 |
| 3,061,057 | | 10/1962 | Miller | 190/44 |
| 3,117,607 | | 1/1964 | Siegel | 150/34 |
| 3,122,225 | | 2/1964 | Ward | 190/52 |
| 3,443,671 | | 5/1969 | Dyke | 190/43 |
| 3,696,850 | | 10/1972 | Rosenblum | 150/33 |
| 3,726,329 | | 4/1973 | Dean | 150/28 R |
| 3,831,651 | | 8/1974 | Leahy | 150/35 |
| 3,955,609 | | 5/1976 | Siegel | 150/35 |
| 3,963,102 | | 6/1976 | Carp | 190/51 |
| 4,081,061 | | 3/1978 | Tucker | 190/52 |
| 4,177,909 | | 12/1979 | Haskell | 224/153 |
| 4,192,365 | | 3/1980 | Siegel | 150/35 |
| 4,206,835 | * | 6/1980 | Shapiro | 190/102 X |
| 4,250,938 | | 2/1981 | Siegel | 150/35 |
| 4,257,463 | | 3/1981 | Monasco | 150/35 |
| 4,263,951 | | 4/1981 | Siegel | 150/35 |
| 4,424,841 | | 1/1984 | Smith | 150/33 |
| 4,431,041 | * | 2/1984 | Leiserson | 190/102 X |
| 4,466,124 | | 8/1984 | Kirkham, Jr. | 383/2 |
| 4,754,790 | | 7/1988 | Meyers | 150/104 |
| 4,770,292 | | 9/1988 | Handler | 220/23.4 |
| 4,811,769 | | 3/1989 | Phares | 150/113 |
| 5,007,540 | | 4/1991 | Beasley et al. | 206/581 |
| 5,031,766 | * | 7/1991 | Cohen | 190/102 X |
| 5,050,713 | | 9/1991 | Lee | 190/108 |
| 5,209,279 | | 5/1993 | Wilson | 150/111 |
| 5,402,869 | | 4/1995 | Saltzman et al. | 190/108 |
| 5,458,278 | | 10/1995 | LaConte | 224/209 |
| 5,509,515 | | 4/1996 | Guo | 190/110 |
| 5,520,462 | * | 5/1996 | Clark | 190/102 X |
| 5,526,924 | * | 6/1996 | Klutznick | 383/111 X |
| 5,660,476 | * | 8/1997 | Decoster | 383/110 X |
| 5,713,439 | * | 2/1998 | Zionts et al. | 190/102 |
| 5,788,032 | * | 8/1998 | Krulik | 190/102 X |
| 5,813,445 | | 9/1998 | Christman | 150/106 |
| 5,881,788 | | 3/1999 | Hersh et al. | 150/116 |
| 5,934,527 | | 8/1999 | Von Neumann | 224/153 |
| 6,076,485 | * | 6/2000 | Peeples et al. | 190/108 X |

FOREIGN PATENT DOCUMENTS

| | | | | |
|---|---|---|---|---|
| 1195440 | * | 11/1959 | (FR) | 190/102 |
| 1562995 | * | 4/1969 | (FR) | 190/108 |
| 2358124 | * | 2/1978 | (FR) | 190/102 |
| 12928 | * | 3/1911 | (GB) | 150/111 |
| 2236475 | * | 4/1991 | (GB) | 190/108 |

* cited by examiner

*Primary Examiner*—Sue A. Weaver
(74) *Attorney, Agent, or Firm*—Loyd W. Bonneville

(57) ABSTRACT

A modular carry-all assembly typically comprising two containers, one of which is connected by emplacement upon the other, each suitable for independent or separate carrying. Examples include a purse, baby supply bag, briefcase and rucksack. Bearing straps of one of the assembly members are extended through a slider band of the other such that the latter pends loosely from the former in a non-integral manner.

9 Claims, 10 Drawing Sheets

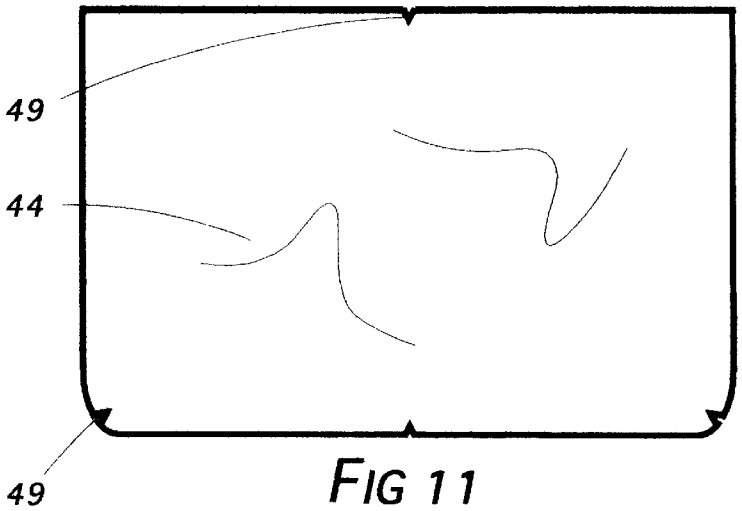
FIG 11
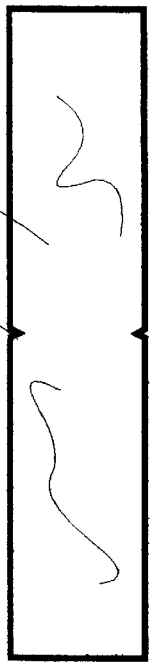
FIG 12
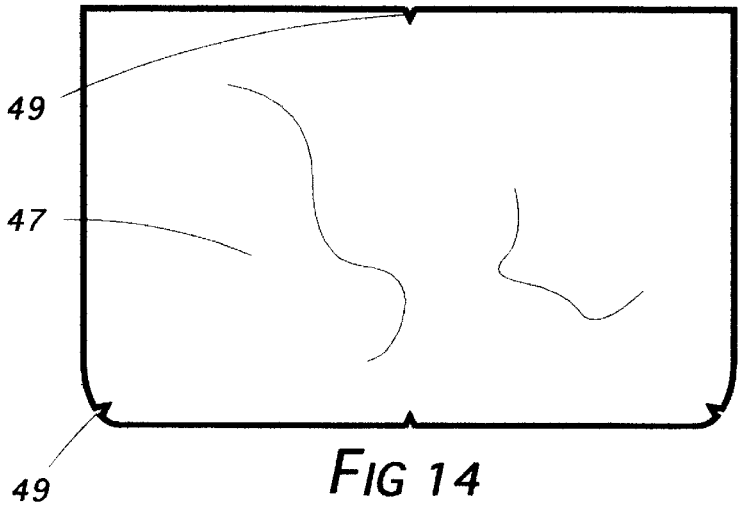
FIG 14
FIG 13
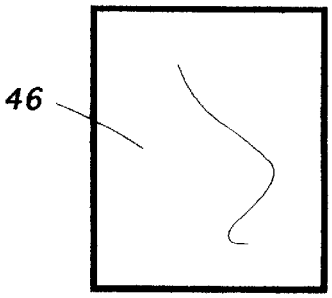
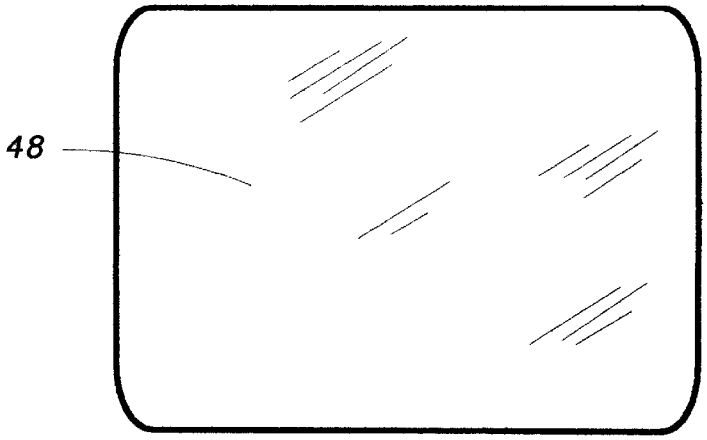
FIG 15

MODULAR CARRY-ALL ASSEMBLY

BACKGROUND OF THE INVENTION

1. Field of the Invention

Purses, briefcases, rucksacks and other carrying devices

2. Description of the Prior Art

Occasionally a descriptive term in this application may be shortened so as to recite only a part rather than the entirety thereof as a matter of convenience or to avoid needless redundancy. In instances in which that is done, applicant intends that the same meaning be afforded each manner of expression. Thus, the term slide strap coupling purse (2) might be used in one instance but in another, if meaning is otherwise clear from context, expression might be shortened to coupling purse (2) or merely purse (2). Any of those forms is intended to convey the same meaning. The term attach or fasten or any of their forms when so used means that the juncture is of a more or less permanent nature, such as might be accomplished by bolts, welds or adhesives. Thus it is stated herein concerning the connection of the bearing straps (10) and the packet case (1) that each strap's anchoring end (10) is attached to the packet case (1). A connection in which one object is easily removed from another is described by the word emplace, as where it is stated herein that the coupling purse (2) is emplaced for assembly upon the packet case (1). Employment of the words connect or join or any of their forms is intended to include the meaning of both in a more general way.

The word comprise may be construed in either of two ways herein. A generic term used to describe a given one of a number of specific elements is said to comprise it, thereby characterizing the specific element with equivalency in meaning for the generic term. Thus, the carry-all assembly may be said to comprise a packet case (1) and a coupling purse (2), meaning that in the particular instance, the case (1) and purse (2) are the entirety of the assembly.

However, the word comprise may also be used to describe a feature which is part of the structure or composition of a given element. Thus, packet case (1) may be said to comprise an emplacement face (11), meaning that the structure of the case (1) is such as to have the emplacement face (11) as a feature of its (1) structure. The meaning in the respective cases is clear from context, however. Accordingly, modifying words to clarify which of the two uses is the intended one seem unnecessary.

Terms relating to physical orientation such as, up, down, higher and lower refer to the positioning of the carrying container in the manner in which it is typically oriented for emplacement or withdrawal of objects. Thus, the zipper or other closure (220) for an external pouch (200) or internal pocket (202) is spoken of as being disposed proximate the top of the case (1) and pattern (42), in FIG. 9, as representing an enwrapment panel which in part forms the bottom thereof (1).

The number of carrying devices—purses, brief cases, rucksacks, luggage and the like—which have emerged in patentable form during the past century is remarkable. The marked variance in burden size required for one occasion as opposed to another presented challenges almost from the start, however. It was observed that on one errand, a small container might suffice, obviating the inconvenience, if not the exhaustion, involved with a partially filled larger piece. It was also noted that while a bulkier one might be required for other ventures, the operator (100) often needed to keep one hand free and, therefore, forgo carrying one container in each. In the course of time, innovative solutions addressed this problem, resolving themselves into what the applicant finds to comprise the three general classes outlined ante.

Where two interconnecting carrying containers are contemplated, ease of connection and separability have been foremost in the inventor's mind. In that respect, small sectors of the prior art have been only partly successful. The few of the following historical examples addressing that objective fail in other respects—such as convenience in accessibility and transport or bulkiness of design, for example. Too often, the connection between the interconnecting parts is too tight, demanding more of the operator (100) and sometimes causing separation wear upon the respective bags as they are being pried apart. The highly praised zipper has occasionally been known to fail at the precise moment rapid connection or disconnection is desired.

What is really needed in an assembly which permits almost instantaneous connection and removal; comprises looseness—or play—between the connected parts; and allows the one to associate with the other in a manner which is not integral but rather, in unified but partially separated relationship. The exploration of the past for structural integrity, it has turned out, has not satisfied mothers who need to take baby bottles, diapers and other paraphernalia with them; or those in business who sometimes carry lap-top computers along with their client files and, perhaps, a ledger book or two. One need only look around to see that the clever zipped or snapped together contraptions of the prior art are not there. For the most part they fail abysmally to fill the needs of those "on the go", so to speak. The key to the apparent dilemma of providing connectibility with unity but yet, that separable out-of-the-way character lies in allowing a degree of pendency between them—that is, by constructing one so that it is suspended or essentially hung from the other rather than being tightly bound to it.

At the same time, it would be extremely helpful if the weight of each bag could be borne at a common point such that the straps or handles from each be somehow brought together. Provision for that objective would obviate disadvantages which might otherwise be associated with this sought after loose pendency.

It would also be useful if the assembly, or parts of it, might be carried by either a male or female. A man might carry one of the parts if formed in the manner of a briefcase or rucksack. A woman might carry one of its parts if constructed as a purse or the entire combination if the purse were pending from the second larger piece.

Moreover, the attractiveness of the carrying assembly is more than an incidental matter. Styling in this field is indeed a matter of utility, not merely one of vain ornamentation.

U.S. Pat. No. 587,251 issued to Wilentshik is interesting in portraying part of a 19th Century train of development featuring an arrangement of interior compartments (201) or pockets (202) continuing even until the present day; U.S. Pat. No. 3,963,102 issued to Carp; U.S. Pat. No. 4,177,909 issued to Haskelt; U.S. Pat. No. 4,263,951 issued to Sieget; U.S. Pat. No. 4,754,790 issued to Meyers; U.S. Pat. No. 4,811,769 issued to Phares, and U.S. Pat. No. 5,881,788 issued to Hersh, et al follow that tradition. The Meyers device comprises two purse-like structures of different sizes, the smaller insertable within the larger.

U.S. Pat. No. 1,425,217 issued to Reguski; U.S. Pat. No. 3,117,607, U.S. Pat. No. 3,955,609 and U.S. Pat. No. 4,192,365 all issued to Sieget; U.S. Pat. No. 4,257,463 issued to Monaco; U.S. Pat. No. 5,458,278 issued to LaConte; and U.S. Pat. No. 5,813,445 issued to Christman all feature handbags or similarly functioning carrying devices with external pouches (200), some of the bags additionally comprising flaps and some, interior compartments (201) or pockets (202). The Monaco device also illustrates a smaller purse which slips into one of the pouches (200) to comprise a dual combination.

U.S. Pat. No. 1,425,217 issued to Regulski, supra; U.S. Pat. No. 2,672,903 issued to Machinist; U.S. Pat. No. 2,813,602 issued to MacArthur, U.S. Pat. No. 3,001,566 issued to Lipsitz; U.S. Pat. No. 3,061,057 issued to Miller; U.S. Pat. No. 3,122,225 issued to Ward; U.S. Pat. No. 3,443,671 issued to Dyke; U.S. Pat. No. 3,696,850 issued to Rosenblum; U.S. Pat. No. 3,831,651 issued to Leahy; U.S. Pat. No. 4,081,061 issued to Tucker; U.S. Pat. No. 4,250,938 issued to Siegel; U.S. Pat. No. 4,424,841 issued to Smith; U.S. Pat. No. 4,466,124 issued to Kirkham; U.S. Pat. No. 4,770,292 issued to Handler; U.S. Pat. No. 5,007,540 issued to Beasley, et at, U.S. Pat. No. 5,050,713 issued to Lee; U.S. Pat. No. 5,209,179 issued to Wilson; U.S. Pat. No. 5,402,869 issued to Saltzman, et at, U.S. Pat. No. 5,509,515 issued to Guo; and U.S. Pat. No. 5,934,527 issued to Von Neumann all depict one sort or another of two or more carrying devices in combination in which one is externally connected to another in a manner intended to facilitate separation by the operator (100).

The externally connecting carrying devices, more nearly than the others, are pertinent to the objective of facilitated separability, although they unfortunately entail a tightly fitted integral structure, a relevant consideration where ease of accessibility is a consideration. The Reguiski and Machinist combinations permit the slipping of a small purse or billfold into an external pouch (200). The Machinist, Wilson, Von Neumann, Saltzman, Guo, Ward, Tuckerand Smith containers are zippered together externally, the first three of them providing vertical stacking, the next four, lateral connections and the last of them, connection in either direction. The MacArthur and Lee carrying combination devices illustrate the connection of separate bags along the handle sectors of each, the former with separable mechanical clips and the latter, by hook and loop pads—i.e., Velcro®. The Ward and Tucker assemblies portray a second bag zippered laterally to a first one. In Leahy, the two containers are snapped together, evincing a wallet-like connection to a purse. The Siegel device features connection of a smaller wallet-like carrying device by extension of a tongue on the back side thereof through slots on the exterior of a purse, resulting in a snug—almost integral—connection of the two. The Kirkham device illustrates a backpack, or rucksack, arrangement in which the connection of a sleeping roll to the bag is by way of straps and buckles. The Handlerand Beasley containers illustrate external connection of compactly formed modular units merely by hook and loop connections.

Among the externally connecting carrying devices, the Lipsitz one deserves a closer look. Included within its structure are means for connecting an object to the bottom of the bag. This is a helpful departure from the otherwise tightly integral structure evinced by the general trend of development. In the Lipsitz device, these means are dedicated to providing a place to tie a tripod onto a bag employed to carry photographic supplies. Were a smaller bag or purse substituted for the tripod, many of the needs addressed herein would be at least partially met. However, the Lipsitz structure would not thereby provide sufficient support to keep the second smaller container from flopping about in an objectionable manner. Even the means to hold the tripod themselves must be pulled up tightly, since no other means of retention are present. The Lipsitz device, however, deserves due acknowledgment with reference to the aims of this application.

A review of the foregoing patterns of development demonstrates an extensive variety of approaches to styled convenience. Nevertheless, the needs or objectives pointed out supra thus far remain only partly addressed in the prior art. Some, such as that just immediately discussed, have not been met at all.

Among the latter of the three classes of carrying devices traced out in history supra, the Siegel one most nearly approaches a type of connection which, ignoring its tight fit for the sake of illustration, at least suggests a possible direction an inventor might follow to address those elusive needs and objectives. Certainly, the Siegel combination does not fulfill those particular aims. The purse's doubly slotted exterior, if constructed to allow greater play in the connection, would tend to produce the sought after pendency which is the subject of this application. Such a modification, of course, would defeat Siegel's obvious objective of compactness in his combination and detract markedly from the appearance of the main packet which, after all, was also intended to be carried independently. From the seeds of thought of both Siegel and Lipsitz, supra, however, one might cultivate a loosely connected combination offering the features of pendency, unity without integrity of structure and chic appearance. It is to these ends this application is dedicated.

SUMMARY OF THE INVENTION

The invention comprises a plurality—albeit typically but two—carrying containers capable of interconnection so as to be taken either separately or together so as to address the operator's (100) particular needs of the moment. The novelty of the assembly lies in the manner by which one is emplaced upon the other so as to permit the first to pend—or hang loosely—from the second.

One part of an assembly,—a packet case (1)—thus, resembles a briefcase and contains within a variety of compartments (201) or pockets (202). The case (1), therefore, may be carried independently, or separately, by either a man or woman. The other part of a two-part assembly—a coupling purse (2)—is constructed to permit bearing straps (10) disposed upon the case (1) to extend through a slider band (22) on the purse's emplacement face (21) and to be operably interconnected. Since the purse (2) may optionally be carried separately either as a clutch type hand gripped one or, if comprising strap length adjustability, a short strapped one providing a handle, the slider band (22) is aesthetically constructed to resemble an external pouch (200). The bearing straps (10) comprise bearing strap engaging (16) means of connection—preferably tensioned snap fittings (36)—at the engaging end (18) of each (10).

Both the packet case (1) and coupling purse (2) comprise carrying straps (14, 24, respectively) which, at the midlength of each (15, 25, respectively) are brought together at strap coupling means (30), preferably comprising hook and loop pads (31). At this juncture, the purse's carrying strap (24) is permitted to slide freely through these means (30). To that end, the sector of the means (30) enwrapping the purse's strap (24) is a non-adhering one.

Upon adding a second carrying strap employing simple known prior art means of connection, the packet case (1) becomes a rucksack or book bag which may be used either separately or in conjunction with the coupling purse (2).

BRIEF DESCRIPTION OF THE DRAWINGS

Solid lines in the drawings represent the invention. Dashed lines represent either noninventive material; that not incorporated into an inventive combination hereof; or that which although so incorporated, lies beyond the focus of attention.

FIGS. 8–16 comprise patterns of the various panels required to manufacture the packet case (1), including in FIG. 15, a stiffening panel (48) and in FIG. 16, an interior case pocket panel (50) composed of fabric.

FIG. 24 represents a fabric liner (58) associated with the interior of the purse's accessible face (22); FIG. 25, one (59) dedicated to an interior strip pocket therein (2); and FIG. 26, one (60) for an interior pocket associated with the purse's emplacement face (21).

DESCRIPTION OF THE PREFERRED EMBODIMENT

Figure 1:
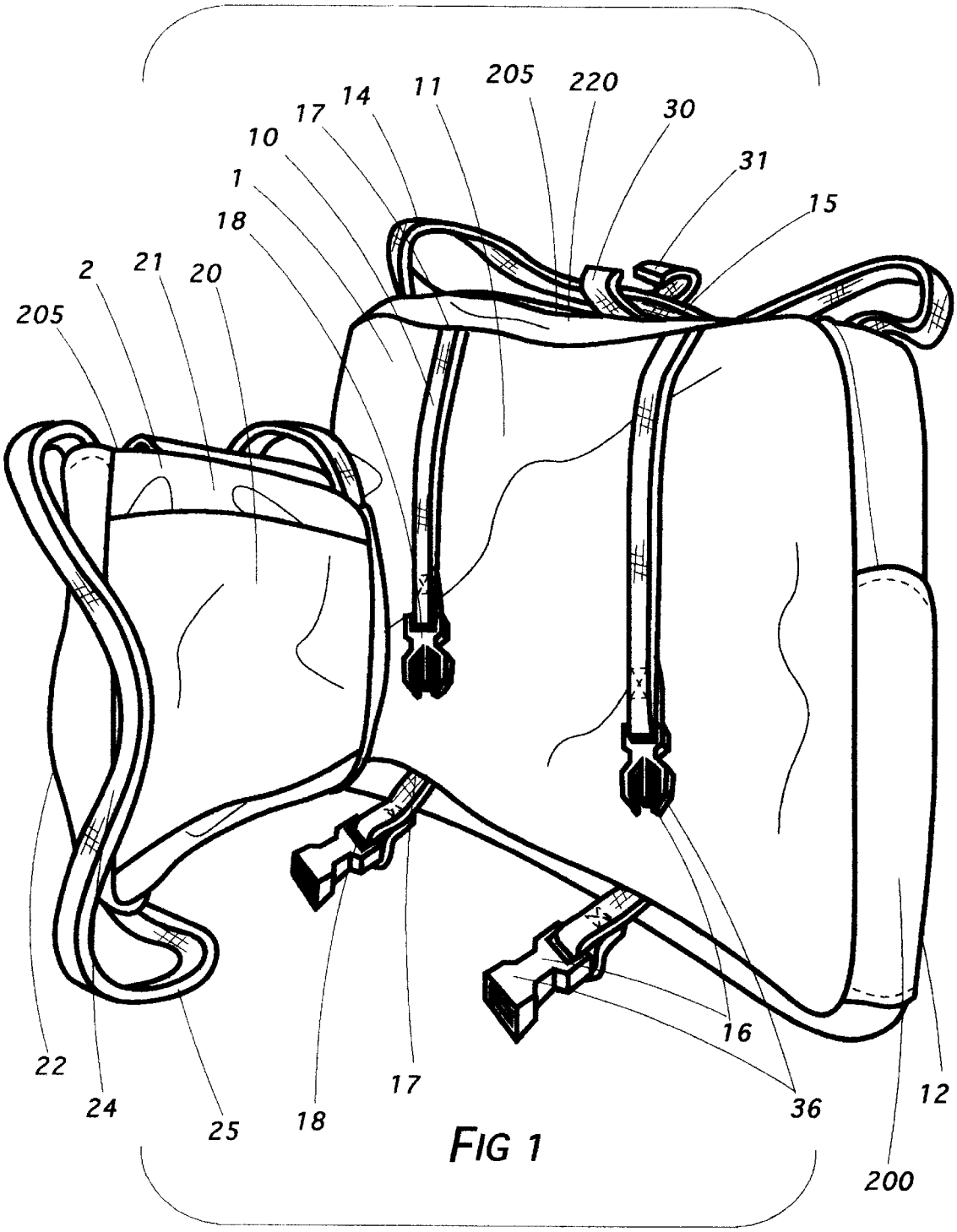
FIG. 1 depicts in perspective the emplacement faces (11, 21, respectively) of the packet case (1) and purse (2) separated from one another and the manner of assembly.

The subject of this application comprises what is identified herein as a modular carry-all assembly. In concept, the invention is adaptable to use in the manner of a woman's handbag, a relatively small form of luggage, a special type of briefcase or a rucksack.

In most applications, the invention may be thought of as comprising two units, although the principle invoked in its creation would also permit an assembly of more than that number thereof. One of the two constituent units generally considered herein comprises a bearing packet case (1) while the other comprises a slide-strap coupling purse (2). By reason of the modular character of these units, the coupling purse (2) may be emplaced upon the packet case (1), thereby markedly adding to the volumetric capacity and character of articles which may be carried by the operator (100) therein. Variations in color combinations are, therefore, also possible to meet styling considerations.

Although the addition of pouches (200), compartments (201) and pockets (202) to the packet case (1) or coupling purse (2) is an optional alternative in manufacture, it is intended by definition herein that each of them (1, 2) comprise a main opening (205). Such is the universal structure of all in prior art, since such an opening (205) is indispensable to their function.

While, for the purposes of this application, there are no conceptional limitations upon the relative sizes of the two units, it is preferable that the packet case (1) be larger then the coupling purse (2) which is emplaced upon it (1). Where more than two such units are contemplated, it is not entirely beyond the realm of practicality to have a third bag or container constructed for emplacement upon the second—the coupling purse (2)—a fourth upon the third, and so on.

The means of emplacement of one (1, 2) to the other (2, 1) comprises one or more pairs of bearing straps (10)—preferably two pairs, or four straps—attached to the packet case (1). Each member of a pair of straps (10) is fixed in place to the case (1) by attachment at its anchoring end (17) as shown in FIG. 1. For aesthetic reasons, attachment is preferably accomplished within the case's (1) interior and may be made conveniently at the seam joining panels discussed ante. Where two pairs (10) are employed, each pair is preferably installed in manufacture parallel the other (10) upon either given face of the case (1). That face thereby becomes the case's emplacement face (11) and the opposing one, the case's accessible face (12), comprising an exterior pouch (200) in traditional prior art fashion, for example.

Each member of a pair of bearing straps (10) also comprises an engaging end (18)—that opposing the anchoring end (17)—which comprises bearing strap engaging means (16) further discussed ante.

The coupling purse (2), to accommodate the emplacement means, comprises a slider band (20) attached at both its (20) ends upon a given face of the purse (2). As with the case (1), just supra, that face becomes the purse's emplacement face (21) and the opposing one, its accessible face (22).

Figure 2:
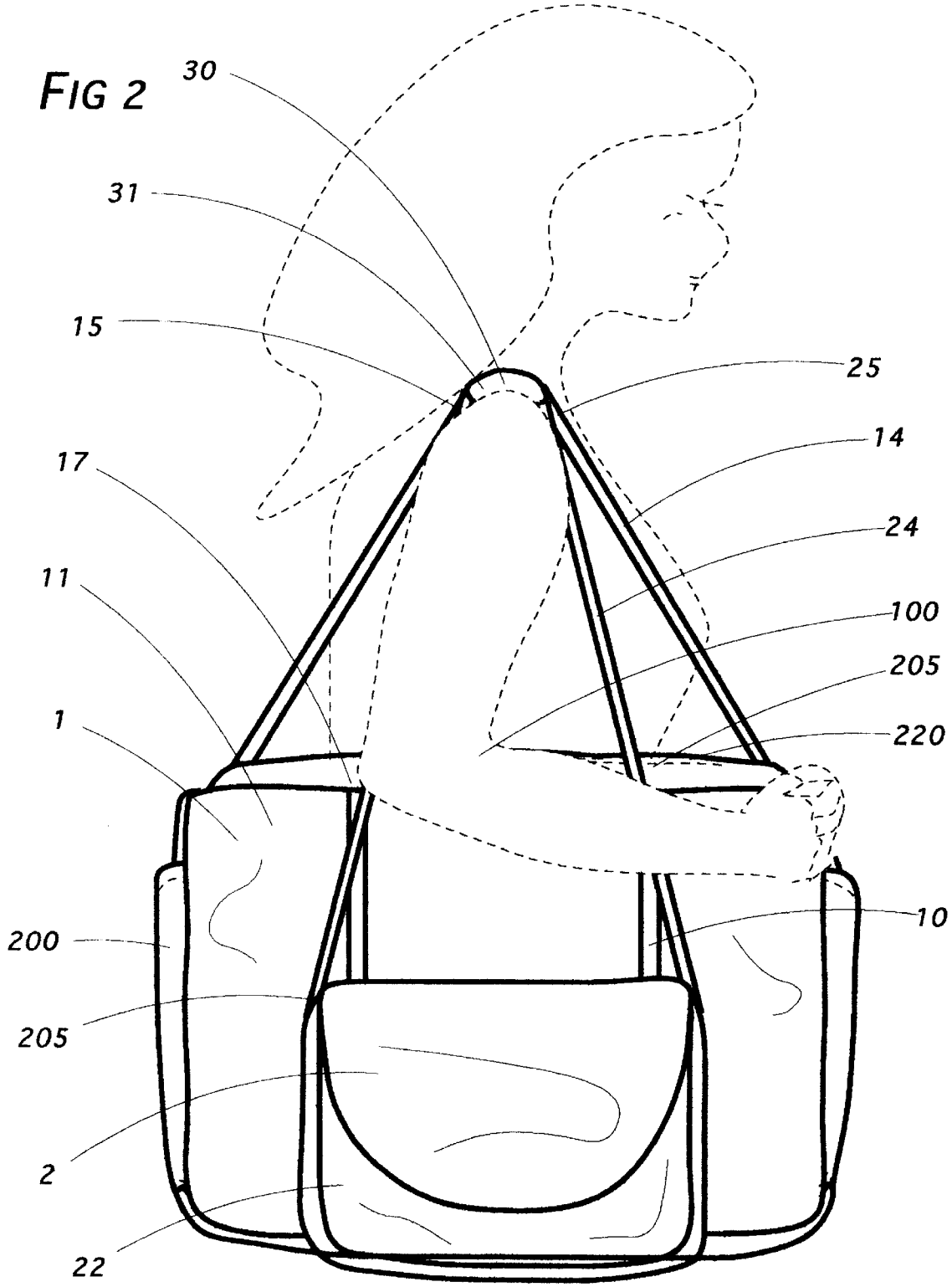
FIG. 2 illustrates the manner in which the packet case (1) and purse (2) are carried over the operator's (100) shoulder, thereby exposing to view the purse's accessible face (22) and, in part, the case's emplacement face (11). This figure also demonstrates the important pending relationship of the purse (2) to the case (1).
Figure 3:
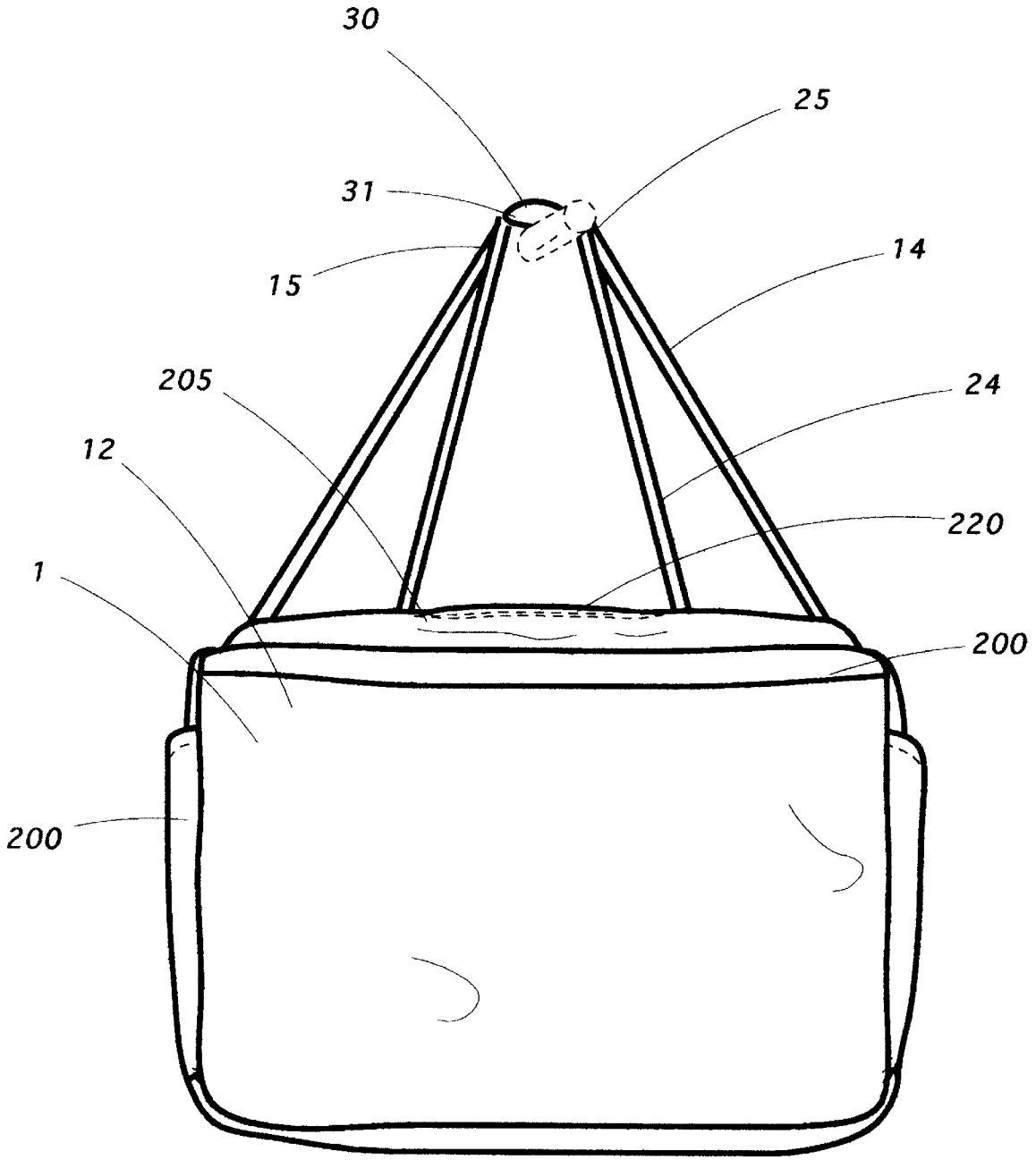
FIG. 3 comprises a view of the packet case's accessible face (12) during stowage in which the case (1) and purse (2) are interconnected.
Figure 5:
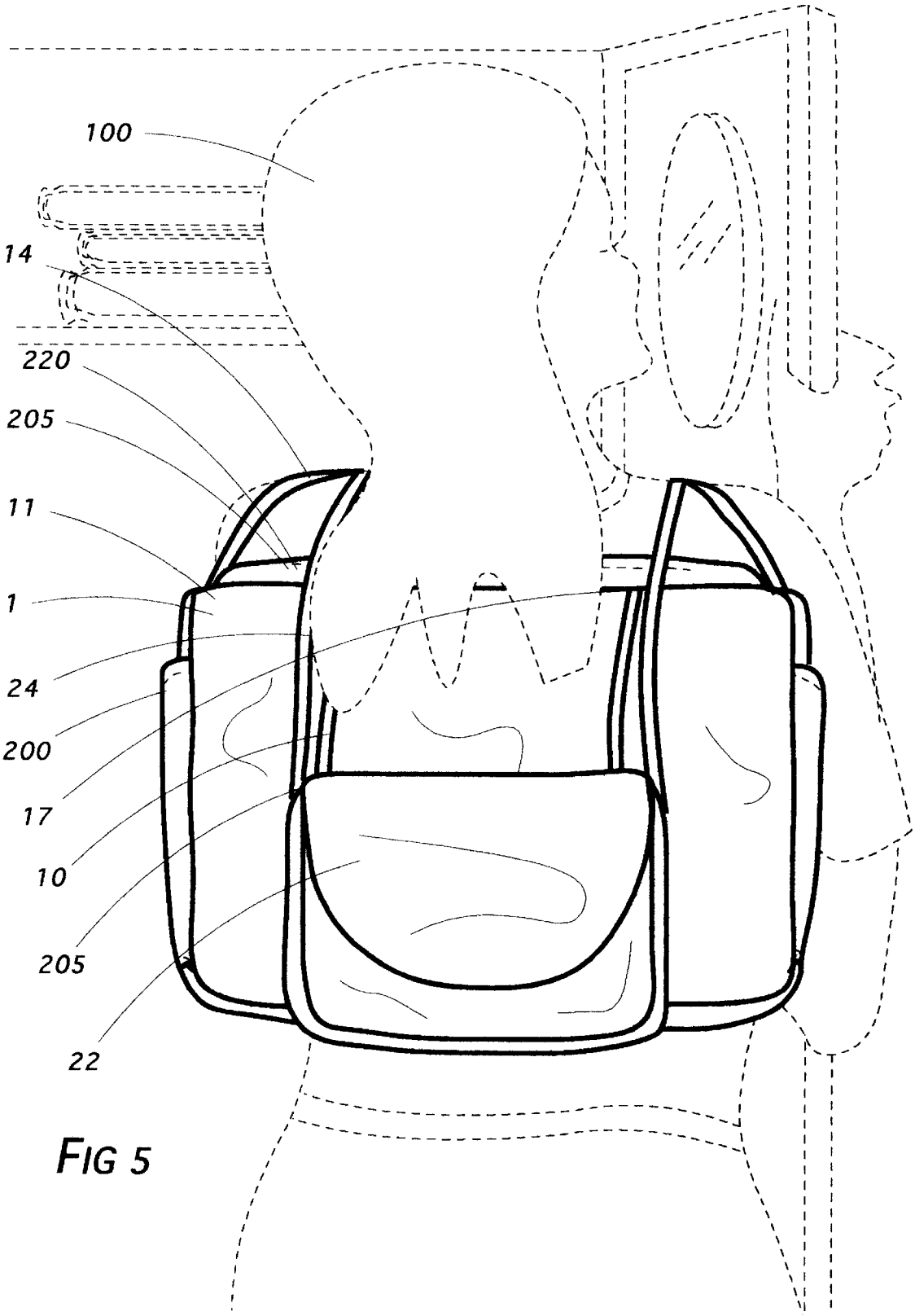
FIG. 5 comprises a view of the packet case (1) and purse (2) interconnected in the manner of the disclosure herein and worn in rucksack fashion FIG. 6 demonstrates a top view of one embodiment of the packet case (1) disclosing, in part, the interior thereof comprising a compartment (201).
Figure 6:
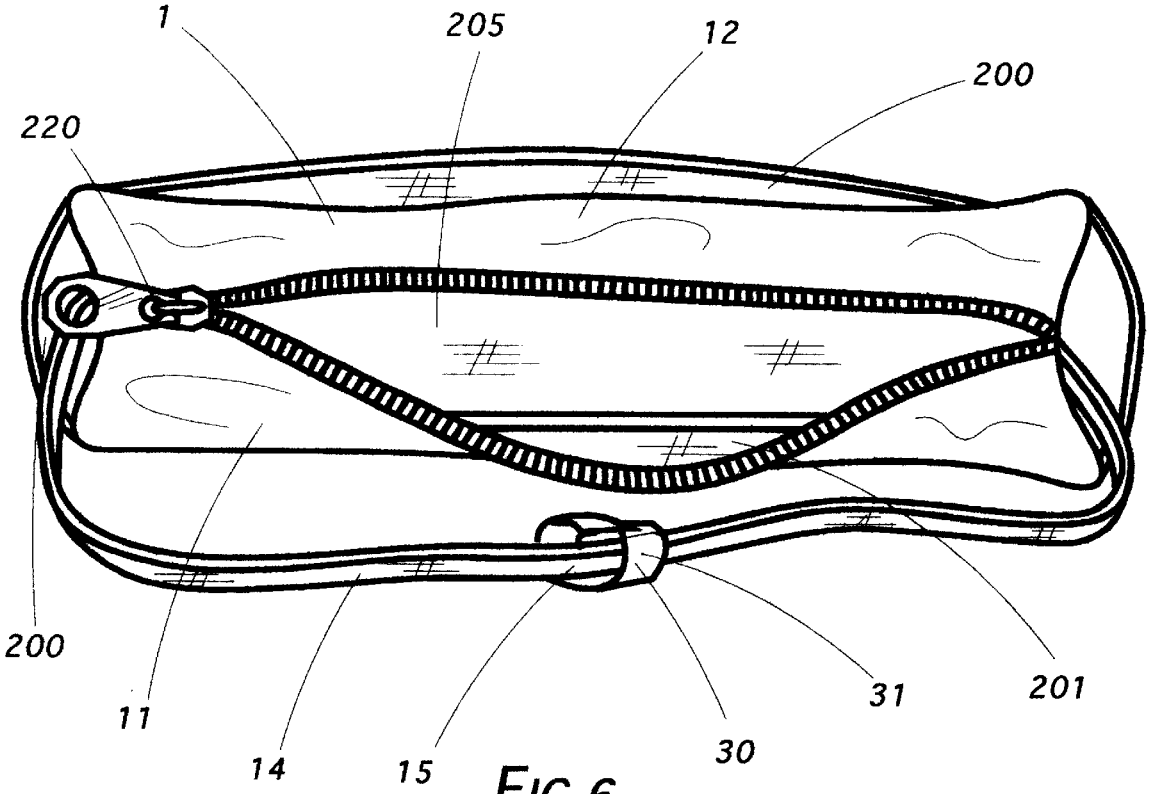
Figure 7:
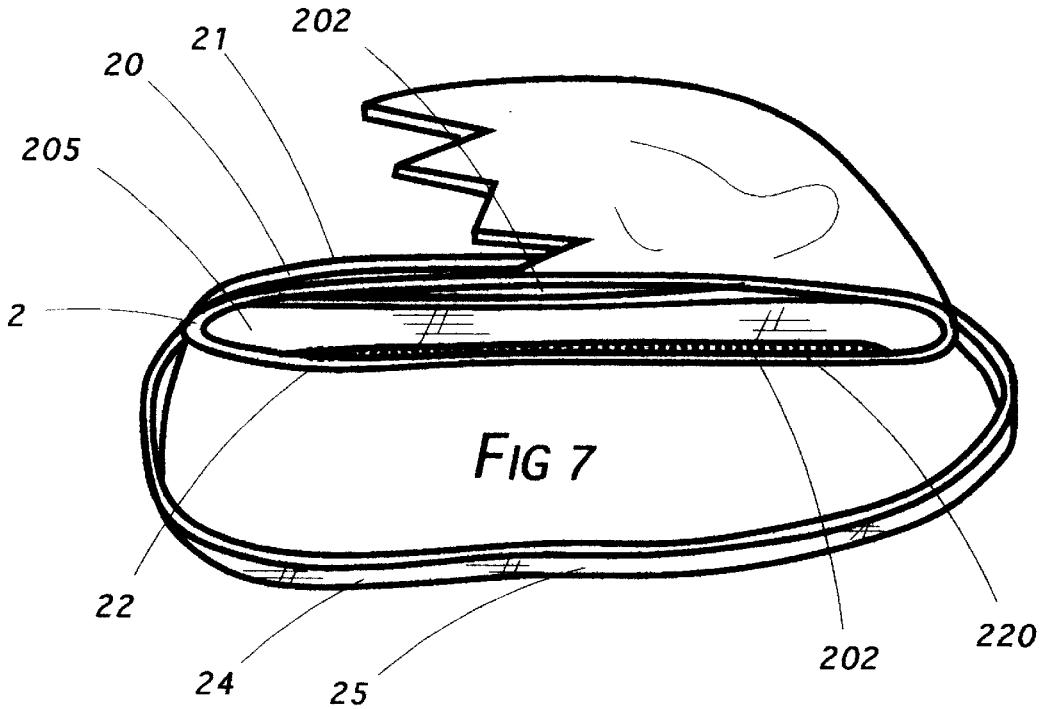
In FIG. 7, part of the purse's (2) flap has been cut away to disclose the interior of an embodiment in which pockets (202) are shown, one of which is zippered in traditional prior art fashion.

The disposition of the bearing straps (10) and that of the slider band (20) are such that they (10) are oriented normal one another (10) for mounting or emplacement purposes. Thus, in a preferable embodiment, where the packet case (1) may be thought of as having horizontal and vertical aspects with a zippered, flapped or open top, the bearing straps (10) are disposed vertically upon its emplacement face (11). The purse (2), also considered as having horizontal and vertical aspects with a zippered, flapped or open top, is constructed such that the slider band (20) is disposed horizontally upon its emplacement face (21). The bearing straps (10) and slider band (20) are operably caused to co-engage, or engage one another (10, 20) such that the purse (2) is supported upon the packet case (1) in pensile fashion—that is, pending or hanging from it (1) as shown in FIGS. 2 and 5.

It is preferable that the emplacement of the coupling purse (2) upon the packet case (1) comprise some looseness or play to it. To avoid coupling and uncoupling inconvenience and to allow the purse to find its own gravitational position upon emplacement, the bearing straps (10) are constructed of length such that the two (1, 2) are not joined too snugly. Upon emplacement of the two primary members of the assembly (1, 2), the purse (2) is thereby disposed to be slid up and down the bearing straps (10) freely by the operator (100).

By reason of the construction of the emplacement features of the two respective units (1, 2), either (1, 2) may be carried separately by the operator (100) for one particularized use or another and when so carried, comprise an independent unified appearance. That is, when either the packet case (1) or the purse (2) is carried separately, it (1, 2) will not suggest that it (1, 2) is only a part of some other more complex assembly but, rather, exhibit the look of any other singular purse or bag.

To make mutual emplacement of the two units (1, 2) feasible, the packet case's bearing straps (10) comprise what is termed herein as engaging means (16) at their engaging ends (18). While several means (16) are known to prior art, spring tensioned snap fittings (36), such as those observed on school bags, are preferable. Such means (36), readily available in plastic composition, are convenient, attractive and economical to manufacture. It should be apparent that while the bearing straps (10) comprise engaging means (16) so that they (10) may be operably opened for emplacement, the purse's slider band (20) requires no such means and, therefore, comprises unbroken unified structure throughout its (20) length.

Figure 4:
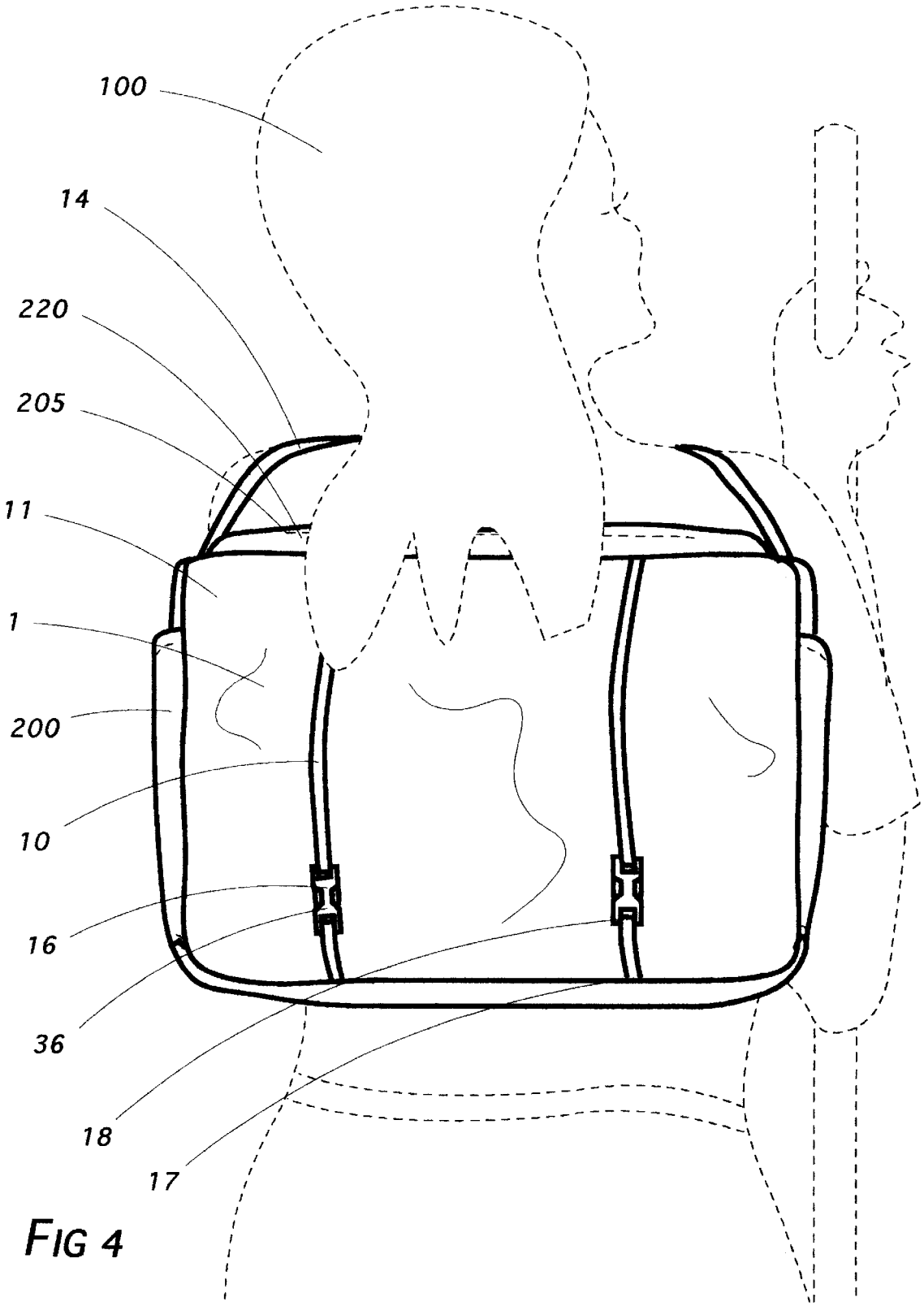
FIG. 4 represents a view of the packet case's (1) use as a rucksack in which two, rather than merely one case carrying straps (14) are attached to the case (1), each running over the operator's (100) shoulders, forward and then back under the arms in traditional prior art fashion.

Although either of the two mutually emplacing parts (10, 20) might be divided so as to comprise engaging means (16), it is preferable for the sake of appearance that they (16) be disposed upon or within the straps (10) and not upon the slider band (20). This permits the purse (2) to comprise a wider, more attractive slider band (20), even though it (20) is disposed upon its (2) back face—the emplacement one (21), that nearest the packet case (1), as is preferably the case (1)—after emplacement. A wider band (20) at its (20) seams tends to resemble an ordinary pouch (200) and does not detract from appearance as straps (10) with bulkier engaging means (16) might do. The purse (2), it should be remembered, will frequently be carried independently, separate from the bag. While it is also recognized that the typically larger packet case (1) may also optionally be carried separately as shown in a rucksack embodiment in FIG. 4, the openable bearing straps (10) are not as conspicuous thereon (1).

It is preferable that both the bearing packet case (1) and the slide-strap coupling purse (2) comprise handle-type means for carrying them (1, 2). Thus, the packet case (1) may comprise a case carrying strap (14) and the coupling purse (2), a purse carrying strap (24). While it is true that the coupling purse (2) pends, or hangs, from the packet case (1) by reason of the connective emplacement featured herein and may, therefore, be considered not to require additional carrying means, it is preferable that such means (24) be present in order to stabilize the purse (2) while is being carried upon emplacement as shown in FIG. 2. In traditional fashion, the carrying straps (14, 24) are attached at each of their (14, 24) ends to the respective units (1, 2) as shown in FIGS. 1–5.

A singular case carrying strap (14) is attached to the packet case (1), in one embodiment thereof (1), and comprises sufficient length that it may provide support in satchel fashion upon either of the operator's (100) shoulders. A singular purse carrying strap (24) of such length, in one embodiment thereof (2), is similarly attached to the coupling purse (2). To avoid unnecessary dangling of either of the straps (14, 24), it is preferable to provide carrying strap coupling means (30) for joining them (14, 24) together at the operator's (100) shoulder—the point of support.

The carrying strap coupling means (30) may comprise any one of a number of configurations. Preferable, however, is hook and loop means (31)—such as Velcro® pad—attached to one of the carrying straps (14, 24) at its midlength (15, 25), which permits enwrapment thereof (31) around the other carrying strap (24, 14) at its midlength (25, 15) such that the two straps (14, 24) seat conveniently upon the operator's (100) shoulder as shown in FIG. 2. In keeping with the notion that it is preferable to configure the purse (2) with as little as is feasible in the way of appendages so that it (2) may be carried independently with convenience, the strap coupling means (30) attachment should best be to the case carrying strap (14) rather than to the purse carrying strap (24).

It is, of course, preferable to attach the strap coupling means (30) to one of the straps (14, 24) to avoid losing it (30). The means' (30) attachment merely to either one rather than both of the carrying straps (14, 24) permits the other (24, 14) to slide freely within the means' (30) enwrapment. This free sliding allows the assembly to hang properly from the operator's (100) shoulder as shown in FIG. 2 such that its weight is evenly distributed. To assure this free-sliding property upon the coupling purse's carrying strap (24), the strap coupling means (30) comprises a sector free of frictional or adhesive material. Thus, where hook and loop coupling means (31) are employed, the portion thereof (31) contacting the purse's strap (24) is smooth while that (31) clamping upon itself (31) in enwrapment comprises hook and loop padding. If other than hook and loop means (30) are employed, known prior art connections—buckles and slides and the like—are incorporated into the structure.

It should be recognized, of course, that the coupling purse (2) may be configured either with or without a carrying strap (24). If one (24) is present, the purse (2) may be carried about independently like any other over-the-shoulder purse. It should also be recognized that the purse (2) may be configured with a carrying strap (24) of shorter length so that it (24) may be taken conveniently in the hand in typical clutch fashion rather than looped over the operator's (100) shoulder. In the latter case, no strap coupling means (30) are necessary.

While the assembly is designed to permit use within limits by operators (100) of varying height, arm and waist length, the carrying straps (14, 24) may be made adjustable in length by known prior art means including buckles, manually operated slides and the like.

While purse combinations are traditionally recognized as women's trappings, the packet case (1) is configured so that it may be inconspicuously carried by a man in the manner of a briefcase. The case (1) may be carried in a hand held manner rather than over the shoulder. To that end, the carrying strap (14) may be folded over upon itself (14) and held in place by the coupling means (30) to provide a smaller handle.

In another embodiment of the invention, the bearing packet case (1) comprises two carrying straps (14), one for each shoulder so that the case (1) may be used as a rucksack—that is, supported by the operator's (100) back and shoulders rather than along either side in satchel fashion. It should be recognized, of course, that a carrying strap (14) employed with a rucksack would be shorter than one for over-the-shoulder satchel use. If the coupling purse (2) also comprises a purse carrying strap (24) in a rucksack embodiment, the principle of joining the straps with hook and loop means (31) is also preferable. Two of such coupling means (30) would, therefore, be employed—one (30) for each shoulder.

No inventive claim is made herein as to the various pouches (200), compartments (201) or pockets (202) which may be installed in either the bearing packet case (1) or the slide-strap coupling purse (2), since they (200, 201, 202) are well known to prior art. However, great utility lies in configuring the assembly with sections fitted to carry cosmetics and a variety of other objects. The pouches (200) at each of the packet case's (1) ends, shown in FIGS. 1–6, for example, are particularly suitable for baby bottles. Nor is any inventive claim lodged with reference to the various closures (220) which may be employed in one part of the assembly or another—zippers (220), snaps (220), strings (220) and the like. It should be readily apparent, however, that if the packet case (1), for example, were used for dirty baby diapers—a commendable application, indeed—a dependable zipper (220) would be well employed along its (1) top.

To enhance the assembly's appearance, its construction is preferably accomplished by assuring that to the extent possible, the seams be embedded within the interior of the case (1) and purse (2). Thus, the assembly is sewn together inside out.

As mentioned, supra, FIGS. 8–16, represent patterns of panels (41–50) employed in constructing the packet case (1).

Figure 8:
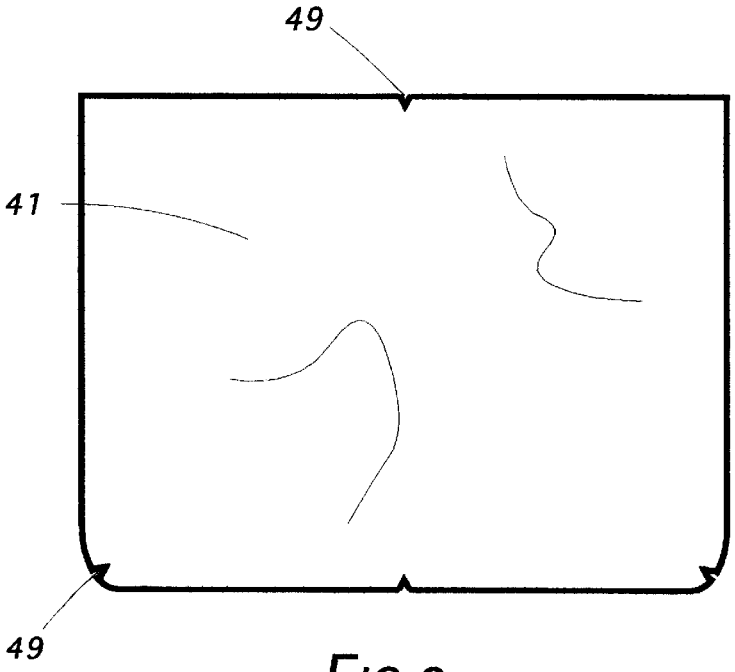
Figure 9:
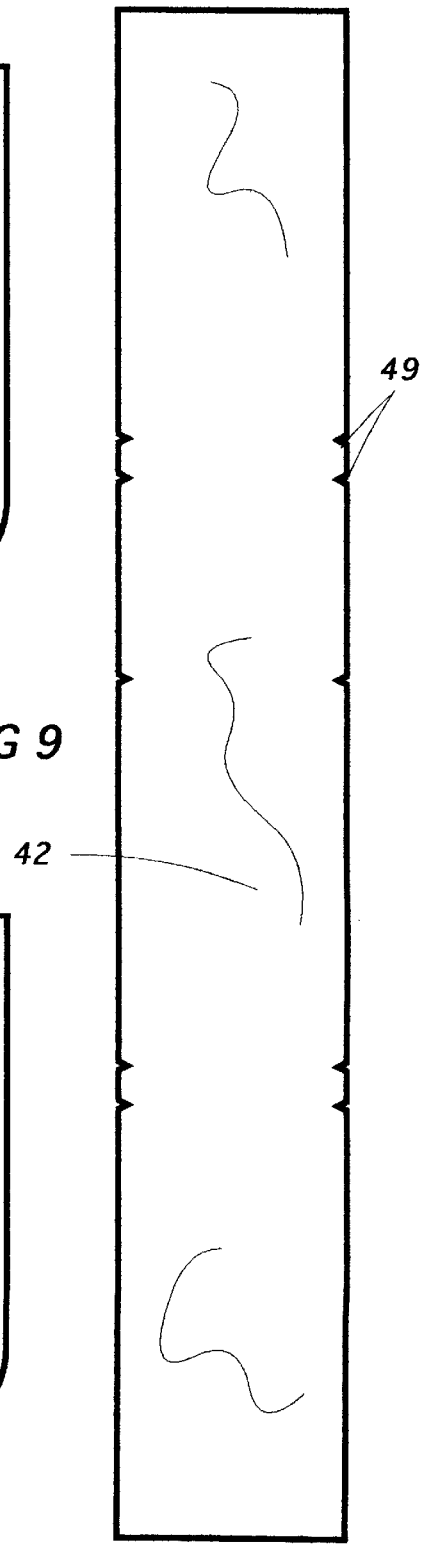
Figure 10:
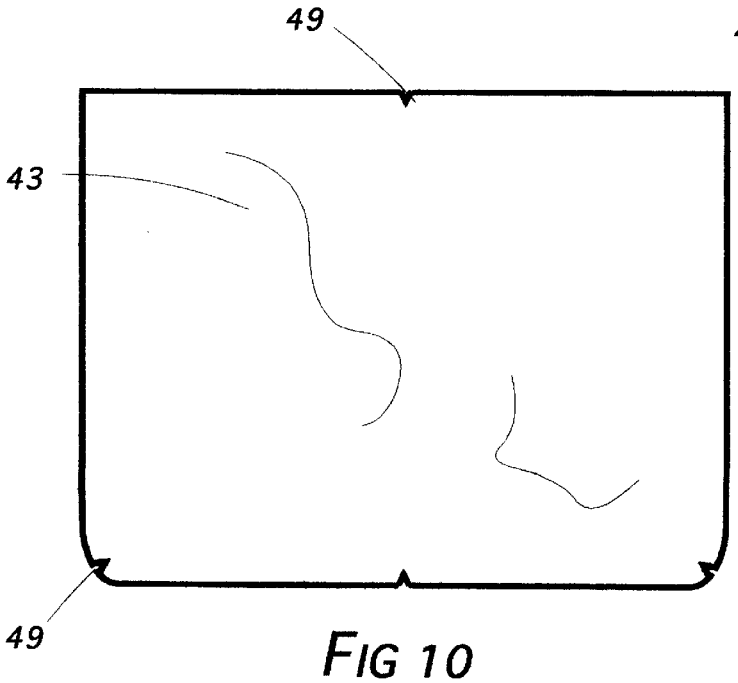

Patterns (41) and (43) in FIGS. 8 and 10 comprise the case's accessible and emplacement face panels, respectively. Pattern (42) in FIG. 9 is that of an enwrapment panel which, when joined to the edges of the face panels (41, 43) forms the sides and bottom of the packet case (1). The tailoring notches (49) shown, well known to prior art, facilitate folding of the materials to avoid puckering.

Pattern (44) in FIG. 11 is employed to provide a pouch (200) on the case's accessible face (12). Pattern (47) in FIG. 14 is employed in one embodiment's construction to provide an interior compartment (201).

Pattern (45) in FIG. 12 comprises one of two closure panels destined to become the top of the case (1). The two (45) are fastened along their edges to the respective face panels (41, 43, respectively). A zipper is preferably installed along the opposing edges.

Pattern (46) in FIG. 13 represents one of two of the case's (1) side pouch panels preferably present to accommodate such items as baby bottles, supra. These panels (46) are merely attached to the exterior of the case enwrapment panel (42).

Pattern (48) in FIG. 15 depicts a stiffening panel preferably present along the emplacement face (11) in the main body of the case (1). This panel (48) may be merely slid into place between the case's (1) exterior and an interior lining mentioned ante.

Figure 16:
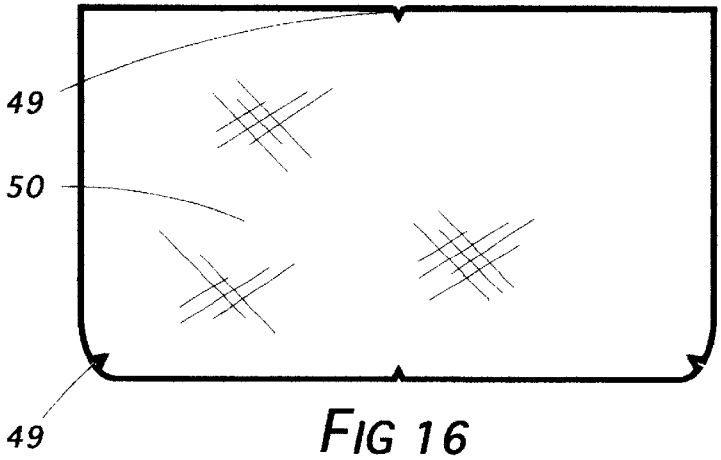

In general, all parts of the assembly are preferably lined with fabric panels. One (50) shown in particular in FIG. 16 is an interior case pocket panel. The exposed edges of such panels (50) are preferably covered with smooth fabric biasing tape.

Also, as mentioned supra, FIGS. 17–26 represent patterns of panels (51–60) employed in constructing the coupling purse (2).

Figure 17:
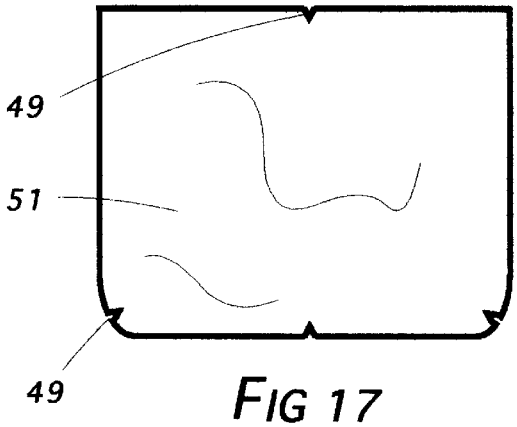
FIGS. 17–26 include patterns of the various panels required to manufacture the purse (2), including stiffening panels (56, 57, respectively), that in FIG. 22 employed in the main body thereof (2) and, in FIG. 23, for the slider band (20).
Figure 18:
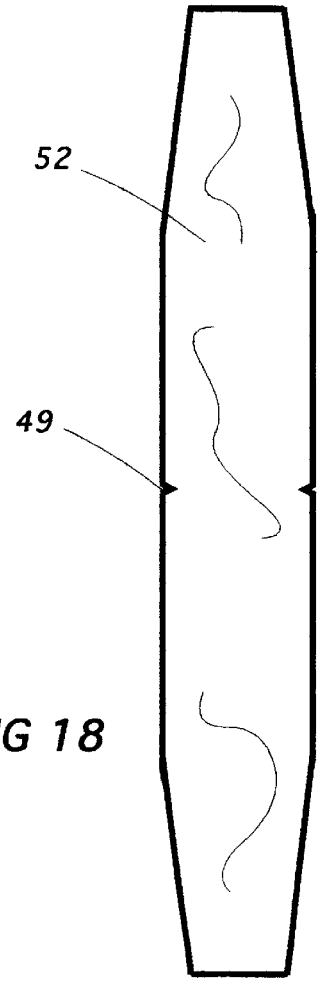
Figure 19:
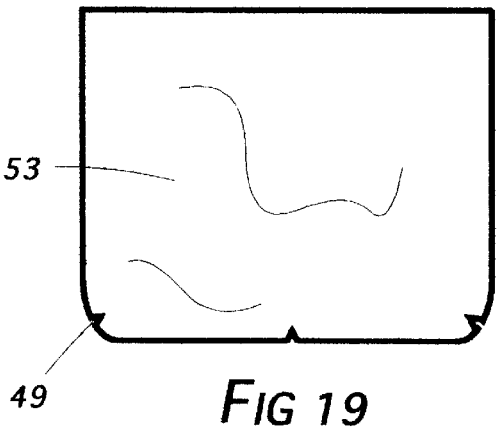

Patterns (51) and (53) in FIGS. 17 and 19 comprise the purse's accessible and emplacement face panels, respectively. Pattern (52) in FIG. 18 is that of an enwrapment panel which, when joined to the edges of the face panels (51, 53) forms the sides and bottom of the purse (1).

Figure 20:
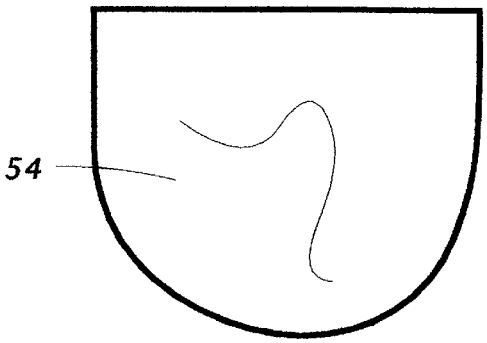

Pattern (54) in FIG. 20 represents a purse flap panel which is attached at its straight edge to the top edge of the emplacement face of the purse panel (53). Known prior art means such as hook and loop pads are employed to fasten the underside of the flap to the purse's accessible face (22).

Figure 21:
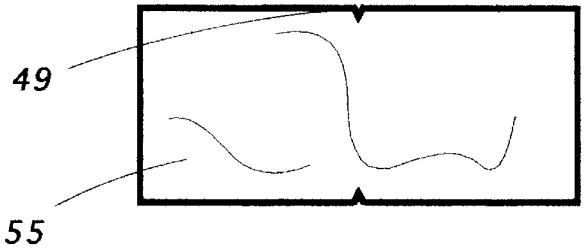

Pattern (55) in FIG. 21 comprises one of two purse slider band panels. These will become fastened back to back to provide a finished surface on both sides of the slider band (20). Before fastening, however, a stiffening panel therefor—represented by pattern (57) in FIG. 23 will preferably be inserted between them (55).

Figure 22:
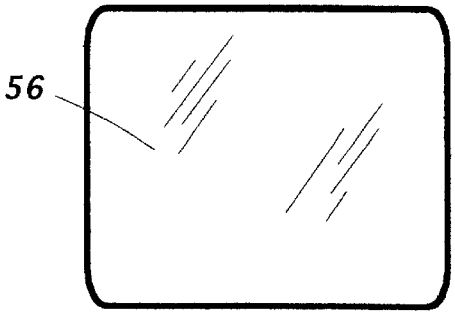
Figure 23:
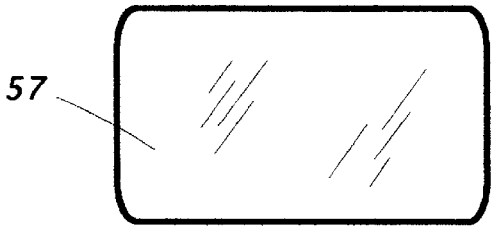

Pattern (56) in FIG. 22 depicts a stiffening panel preferably present along the emplacement face (21) within the main body of the purse (2). This panel (56) may be merely slid into place between the purse's (2) exterior and an interior lining mentioned ante.

Figure 24:
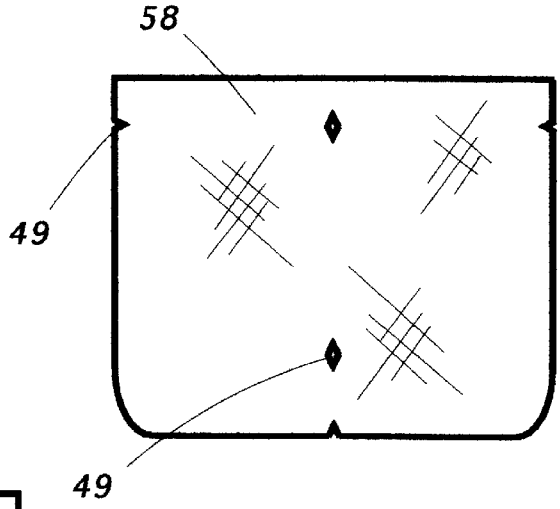

A fabric panel (58) shown in particular in FIG. 24 is an interior case pocket panel formed to fold over for attachment to a zippered interior strip pocket panel (59) discussed ante, thereby forming an upper part of that pocket. Consistent with familiar prior art practices, tailoring notches (49) shown therein are associated with both attachment of the zipper and with hook and loop flap closure means mentioned supra.

Figure 25:
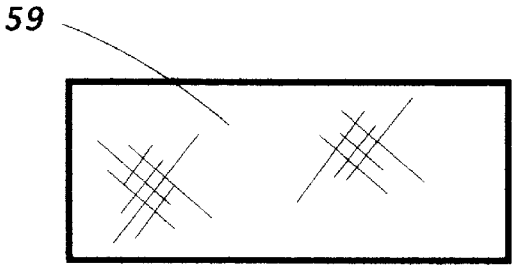

An additional fabric panel (59) in FIG. 25 is preferably included to form the strip pocket just alluded to. In the embodiment contemplated, the pocket comprises a zippered closure (220) at the juncture of the two fabric panels (58, 59).

Figure 26:
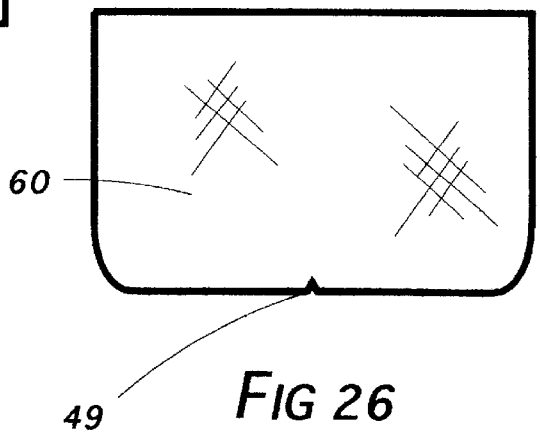

A fabric panel (60) in FIG. 26 intended for installation along the purse's emplacement face (21) is also shown.

What is claimed is:

1. A modular carry-all assembly comprising a bearing packet case; and a slide-strap coupling purse;

the packet case comprising one or more pairs of bearing straps each comprising an anchoring end; and an engaging end;

the anchoring end of each bearing strap disposed by way of attachment to the case;

each strap comprising in turn engaging means wherein the engaging ends of each pair of straps are operably interconnected;

the coupling purse comprising a slider band attached thereto at each end;

whereby the coupling purse may be emplaced in pensile fashion upon the packet case by Inserting the engaging ends of each pair of the case's bearing straps through the purse's slider band and interconnecting the respective engaging means of each strap pair.

2. The modular carry-all assembly according to claim 1 wherein the packet case comprises a satchel in which a singular case carrying strap is disposed such that it may be borne upon either of the operator's shoulders.

3. The modular carry-all assembly according to claim 1 wherein the packet case comprises a rucksack in which two case carrying straps are disposed such that each may be born upon a respective shoulder of the operator.

4. The modular carry-all assembly according to claim 1 wherein the packet case comprises a plurality of specially formed utility pouches, compartments and pockets.

5. The modular carry-all assembly according to claim 1 wherein the slide strap coupling purse comprises a plurality of specially formed utility pouches, compartments and pockets.

6. The modular carry-all assembly according to claim 1 wherein the coupling purse comprises a purse carrying strap attached thereto at each end.

7. The modular carry-all assembly according to claim 6 wherein the packet case comprises a case carrying strap comprising in turn carrying strap coupling means along its midlength and the coupling purse's carrying strap comprises length such that it may be emplaced to slide freely within the coupling means;

whereby the packet case and coupling purse are supported upon the operator at a common site.

8. The modular carry-all assembly according to claim 7 wherein the carrying strap's coupling means comprises a hook and loop pad attached to the midlength of the packet case carrying strap.

9. The modular carry-all assembly according to claim 1 wherein the coupling purse comprises a carrying strap comprising in turn adjustable length means along its midlength; whereby the purse may be carried independently in clutch and shortened handle fashion by the operator.

* * * * *